United States Patent [19]

Watton

[11] 4,337,912

[45] Jul. 6, 1982

[54] FAIL SAFE RETRACTABLE LANDING GEAR UNIT FOR MODEL AIRCRAFT

[76] Inventor: William J. Watton, 1421 Aries Ct., Chula Vista, Calif. 92011

[21] Appl. No.: 133,974

[22] Filed: Mar. 26, 1980

[51] Int. Cl.[3] ..... A63H 27/02; B64C 25/26

[52] U.S. Cl. ..... 244/102 R; 46/76 R

[58] Field of Search ..... 244/100 R, 102 R, 102 SL; 46/77, 78, 76, 74

[56] References Cited

U.S. PATENT DOCUMENTS

| | | | |
|---|---|---|---|
| 3,589,649 | 6/1971 | Leclercq | 244/102 R |
| 3,739,519 | 6/1973 | Garabello | 244/102 R |
| 3,752,421 | 8/1973 | Harvey et al. | 244/102 SL |
| 3,900,988 | 8/1975 | Garabello | 244/102 R |

*Primary Examiner*—Galen L. Barefoot
*Attorney, Agent, or Firm*—Brown & Martin

[57] ABSTRACT

A fail safe retractable landing gear unit for model aircraft utilizing a fluid pressure powered piston type activator to retract and hold the landing gear retracted with sustained pressure. Upon release or loss of pressure a return spring acting on the piston automatically extends the landing gear. The hinged retracting mechanism and the activator are mounted rigidly in a unitary bracket, which holds the activator in sealed condition and precise alignment, the mechanism having positive locking in the retracted and extended positions to minimize landing gear loads on the mechanism and activator. Only a single pressure connection is required to each unit in a multiple unit landing gear installation.

2 Claims, 7 Drawing Figures

FAIL SAFE RETRACTABLE LANDING GEAR UNIT FOR MODEL AIRCRAFT

BACKGROUND OF THE INVENTION

Various types of retractable landing gear have been devised for model aircraft, particularly those operated by radio control. Some types are activated by an electric motor driven servo coupled to the landing gear by linkage. Others have an individual electric motor on each landing gear unit, with a reduction gear drive to retract and extend the leg. The primary problem with the electrically driven system is that, in the event of any type of electrical failure the landing gear is locked in place. If the gear is retracted in flight the aricraft must make a wheels up landing, with resultant damage to the structure.

Some systems use fluid pressure, such as air or Freon, to operate the landing gear. One such system is disclosed in U.S. Pat. No. 3,739,519, in which each landing gear unit is activated by an individual double acting cylinder mounted on the outside of the unit. Fluid pressure is supplied through a four way valve to retract and extend the landing gear selectively, the valve being activated by a servo. In present radio control equipment servos have become very reliable and the particular servo controlling the landing gear is used very little, so it is not subject to heavy wear. However, in the fluid pressure system there are numerous hoses and connections and a pressure leak is more likely to be a cause of failure. With the system in the above mentioned U.S. Patent, in which the landing gear is driven in both directions by pressure, any leak can result in the landing gear being stuck in its current position.

SUMMARY OF THE INVENTION

In the landing gear described herein, each unit has an individual single acting cylinder to retract the leg, which is held in retracted position by sustained pressure. When the pressure is released, a spring incorporated in the cylinder automatically extends the leg, so that any loss of pressure results in a fail safe extension of the landing gear. Fluid pressure is provided from a suitable source through a simple servo controlled valve, which selectively supplies pressure to the cylinder to retract the leg and then vents it to atmosphere when the landing gear is extended.

To avoid excessive loads on the mechanism and the cylinder and to minimize the holding pressure required, each unit has a positive lock in both the retracted and extended positions. In addition, the cylinder is mounted within and held by the bracket on which the landing gear leg is hinged, which provides protection and support for the cylinder and makes the assembly very compact.

The primary object of this invention, therefore, is to provide a new and improved fail safe retractable landing gear unit for model aircraft.

Another object of this invention is to provide a fail safe retractable landing gear unit which is compact and simple to install in various positions in an aircraft structure.

Other objects and advantages will be apparent in the following detailed description, taken in conjunction with the accompanying drawing, in which.

DESCRIPTION OF THE PREFERRED EMBODIMENT

Figure 1:
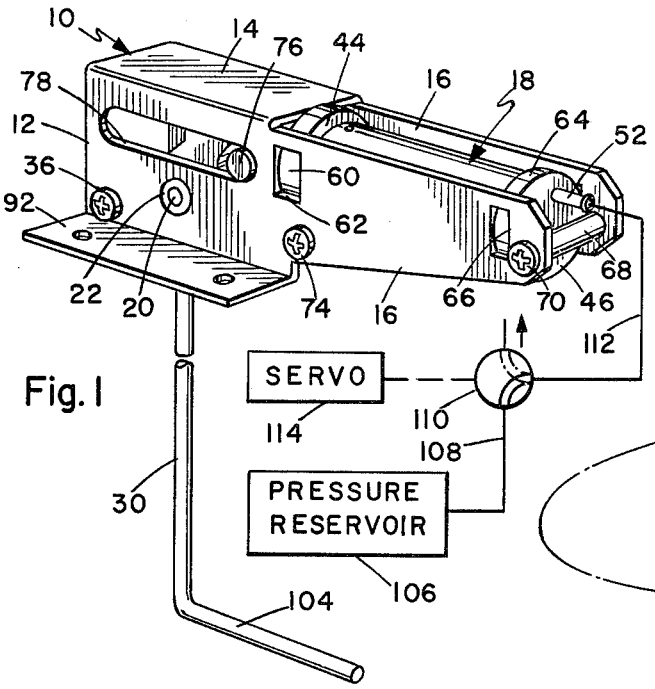
FIG. 1 is a perspective view of one landing gear unit, with the activating system indicated schematically.
Figure 2:
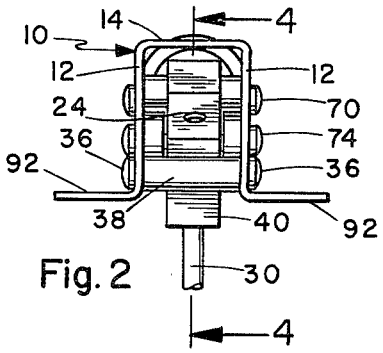
FIG. 2 is an end view as taken from the left side of FIG. 1.

The landing gear unit is self-contained in a bracket 10 having side walls 12 joined by a top wall 14 in an inverted U-shaped configuration. Side walls 12 have longitudinally extended portions 16 between which the actuator 18 is secured.

Fitted between the side walls 12 is a hinge pin 20 which is journalled in bushings 22, and pivotally mounted on the hinge pin is a hinge block 24 secured to the pin by a set screw 26. The hinge block 24 has a socket 28 to receive the upper end of a landing gear leg 30, which is locked in place by a set screw 32.

Figure 4:
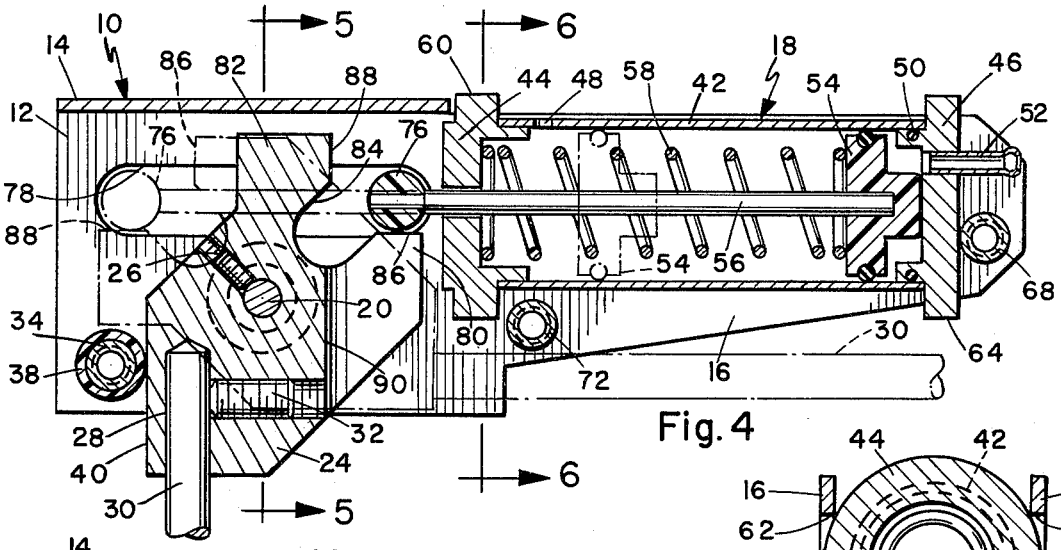
FIG. 4 is an enlarged sectional view taken on line 4—4 of FIG. 2.
Figure 5:
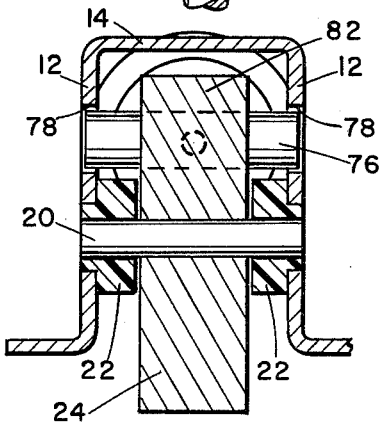
FIG. 5 is a sectional view taken on line 5—5 of FIG. 4.
Figure 6:
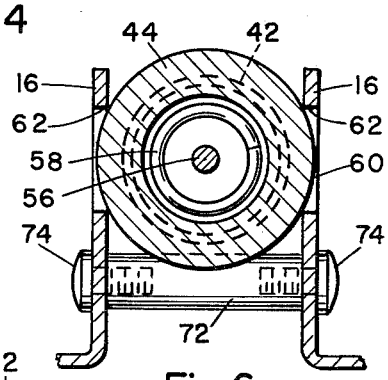
FIG. 6 is a sectional view taken on lien 6—6 of FIG. 4.

Adjacent the lower corner of side walls 12, remote from the extended portions 16, is a spacer 34 secured perpendicularly between the side walls by screws 36 into opposite ends. The spacer 34 is enclosed by a bumper sleeve 38 of plastic or the like. Hinge block 24 has a stop face 40 substantially parallel to the axis of leg 30. In the extended position of the leg, illustrated in full line in FIG. 4, the stop face 40 bears against bumper 38 and limits the downward motion of the leg.

Actuator 18 comprises a cylindrical body 42 having an inner end cap 44 and an outer end cap 46. End cap 44 may be a press fit in the body 42 and need not be sealed, the body having a vent opening 48 adjacent that end. End cap 46 is sealed in the body by an O-ring 50 and is provided with an inlet 52 connector to admit fluid pressure. In the body 42 is a piston 54 secured to a piston rod 56 which slides axially through end cap 44, the piston 54 being biased toward end cap 46 by a return spring 58.

End cap 44 has a radially projecting flange 64 which seats in opposed slots 66 in the extended portions. The actuator 18 is thus held without any special fasteners and without requiring a screw threaded or clamped connection for the sealed end cap 46. To hold the actuator securely in place, a a spacer 68 is secured by screws between the ends of extended portions 16, against the outer face of end cap 46. A further spacer 72 is secured by screws 74 between the extended portions adjacent end cap 44. The screws holding the three spacers 34, 68 and 72 thus hold the entire assembly in rigid alignment, making it very simple to dismantle the unit for servicing.

Fixed on the projecting end of piston rod 56 is a cylindrical actuating bar 76, the ends of which ride in opposed guide slots 78 in the side walls 12. The upper end of hinge block 24 has a forked portion with arms 80 and 82 on opposite sides of a notch 84. Arm 80 has a locking face 86 which, in the extended position of the unit, is locked under the actuating bar 76, as in the full line position in FIG. 4. The hinge block is thus securely locked between the actuating bar 76 and bumper 38 to absorb landing loads. Arm 82 has a locking face 88 perpendicular to face 86.

When the piston is driven to the left by fluid pressure, actuating bar 76 slides off locking face 86 into notch 84 and engages arm 82. Continued motion swings the hinge block 24 and retracts the leg 30 to the broken line position in FIG. 4. In the fully retracted position the actuating bar 76 engages the locking face 88 and holds the hinge block securely in place, with leg 30 extending below the actuator 18. Arm 80 has a channel 90 to provide clearance for piston rod 56 in the retracted position. In both positions the load is primarily supported by the actuating bar against one or the other of the locking faces on the hinge block. Since the ends of the actuating bar are held in guide slots 78, the loads are transferred directly into the bracket structure, not to the actuator. It should be noted that the actuating bar 76 and the bushings 22 are preferable of plastic material, in order to avoid any moving metal to metal contact which might cause interference in the radio control system.

Figure 3:
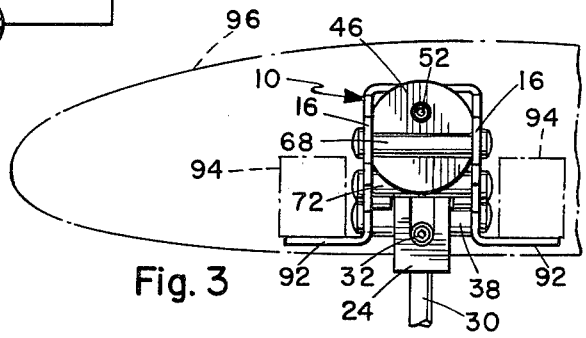
FIG. 3 is an end view as taken from the right side of FIG. 1.
Figure 7:
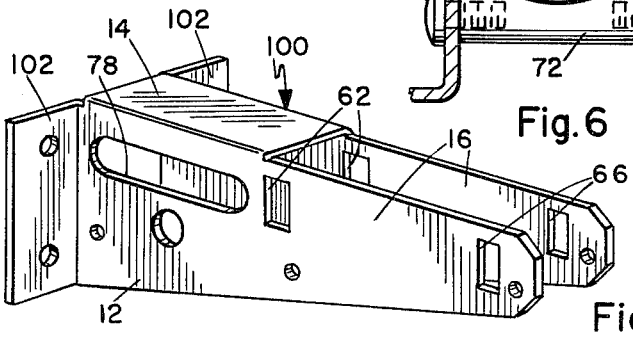
FIG. 7 is a perspective view of a bracket adapted for a nose wheel installation.

To mount the unit in an airframe the lower edges of side walls 12 have outwardly projecting attachment flanges 92. This configuration is suitable for attachment to spaced bearers 94 in a wing 96, as indicated in a broken line airfoil section in FIG. 3. Any suitable screws or bolts may be used to secure the unit in place. If the unit is to be mounted on a bulkhead such as in a nose wheel nacelle installation, a modified bracket 100 may be used, as illustrated in FIG. 7. This bracket 100 is similar in most respects to bracket 10, the similar parts being correspondingly numbered. However, attachement flanges 102 extend from the vertical end edges of side walls 12 for attachment to a vertical surface. The mechanism is thus adaptable to a variety of installations, the lower end of leg 30 having an axle 104 turned in the appropriate direction to carry a suitable wheel, not shown.

In a typical installation, pressurized fluid from a reservoir 106 is carried by a supply line 108 to a two way valve 110, which in one position is coupled by a connecting line 112 to inlet connector 52. Valve 110 is operated by a servo 114 of conventional type such as used in radio control systems. In the other position of valve 110 the actuating cylinder 18 is vented to atmosphere to release the pressure. The reservoir 106 can be a light weight tank with sufficient capacity for several retraction cycles and is easily recharged between flights by a hand pump, or other means.

The compact structure, with the hinged mechanism and the actuator enclosed in a unitary bracket, greatly simplifies installation in an aircraft. The rigid assembly ensures that alignment will be maintained and jamming or binding of the mechanism is essentially eliminated. With the fail safe spring return arrangement only a single air pressure line is needed to each unit, which simplifies the plumbing installation in the aircraft and minimizes the number of couplings where leakage can occur. However, in the event of loss of pressure due to any cause, the return springs will automatically extend the landing gear, so that the aircraft can be landed safely.

Having described my invention, I claim:

1. A fail safe retractable landing gear unit, comprising:

a unitary bracket having side walls and a top wall interconnecting the side walls;

a hinge block pivotally mounted between said side walls and having a landing gear leg secured thereto;

said side walls having longitudinally extended portions;

a single acting fluid pressure operated actuator mounted between said extended portions and having a piston therein, with a piston rod coupled to said hinge block to retract and extend the landing gear leg;

said actuator having an inlet for applying pressure to said piston to retract the landing gear leg;

a return spring in said actuator engaging the piston for extending the landing gear leg completely upon release of pressure;

said piston rod having an actuating bar fixed thereon;

said side walls having opposed straight longitudinal slots in which the ends of said actuating bar are slidably retained;

a bumper secured between said side walls, said hinge block having a stop face for engagement with the bumper in the extended position of the landing gear leg;

said hinge block having a first locking face positioned to be engaged by said actuating bar in the extended position of the landing gear leg, with the hinge block held between the actuating bar and the bumper;

said hinge block having a second locking face perpendicular to the first and positioned to be engaged by said actuating bar in the retracted position of the landing gear leg.

2. The structure of claim 1, wherein said actuator has end caps at opposite ends thereof with extended flanges, said extended side portions having slots in which said flanges are seated and by which the end caps and the actuator are retained in the bracket.

* * * * *